United States Patent [19]

Ruenzi

[11] 4,113,244

[45] Sep. 12, 1978

[54] APPARATUS FOR AUTOMATICALLY FEEDING INDIVIDUAL SHEETS FROM A STACK THROUGH AN OFFICE MACHINE

[76] Inventor: Kurt Ruenzi, Kuesnachterstrasse 59, 8126 Zumikon, Switzerland

[21] Appl. No.: 779,755

[22] Filed: Mar. 21, 1977

Related U.S. Application Data

[63] Continuation-in-part of Ser. No. 674,918, Apr. 8, 1976, Pat. No. 4,032,135.

[30] Foreign Application Priority Data

Apr. 5, 1976 [CH] Switzerland ..... 4207/76
Apr. 15, 1975 [CH] Switzerland ..... 4758/75

[51] Int. Cl.[2] ..... B65H 5/22

[52] U.S. Cl. ..... 271/4; 271/121; 271/127; 271/186; 271/225; 271/270; 271/273

[58] Field of Search ..... 271/4, 121, 122, 127, 271/124, 125, 225, 184, 185, 186, 65, 270, 273

[56] References Cited

U.S. PATENT DOCUMENTS

| | | | |
|---|---|---|---|
| 390,277 | 10/1888 | Allen | 271/127 X |
| 650,410 | 5/1900 | Morin | 271/121 |
| 3,840,222 | 10/1974 | Fowlie | 271/186 X |
| 3,900,192 | 8/1975 | Gibson | 271/110 X |
| 3,966,194 | 6/1976 | Abbe | 271/186 |

*Primary Examiner*—Richard A. Schacher
*Attorney, Agent, or Firm*—W. G. Fasse; W. W. Roberts

[57] ABSTRACT

This apparatus removes individual sheets of paper or the like from a stack regardless of the thickness of each sheet. A sheet supply stack support is journaled in a housing in see-saw fashion. A first set of sheet separating rollers is arranged above the downstream end of the support as viewed in the direction of sheet movement. A spring urges the downstream end of the support upwardly and thus sheets on the support against the first set of rollers. A table is located substantially adjacent said downstream end and below a second set of sheet separating rollers. The table has a cut-out and a sheet separating gate slants through the cut-out below the second set of rollers. The gate is spring biased toward the second set of rollers. Two sheet guides are arranged upstream and downstream, for example, of a platen. The supply stack is arranged upstream of the first sheet guide. The sheet receiving stack is arranged downstream of the second sheet guide and substantially above the sheet supply stack. Both stacks are arranged in relatively flat positions to the horizontal.

7 Claims, 5 Drawing Figures

APPARATUS FOR AUTOMATICALLY FEEDING INDIVIDUAL SHEETS FROM A STACK THROUGH AN OFFICE MACHINE

CROSS REFERENCE TO RELATED APPLICATIONS

This application is a continuation-in-part application of my copending application Ser. No. 674,918, filed Apr. 8, 1976, now U.S. Pat. No. 4,032,135, granted on June 28, 1977.

BACKGROUND OF THE INVENTION

The invention relates to an apparatus for individually removing sheets from a stack of sheets, for example, paper or the like, including a sheet stack support member and several power driven sheet separating roller sets. More specifically, the invention relates to an apparatus for guiding and supplying individual sheets from a stack through an office machine and out again onto a sheet receiving stack.

Sheet separating devices for paper sheets or the like are well known. These devices supply the sheets to office machines, such as printers, duplicators, copiers or to other types of processing. Prior art devices are constructed in such a manner that they must be adjusted precisely to the particular type of paper thickness employed for any particular type of operation. If it is necessary to change to another paper thickness a careful new adjustmment must be made. The required adjustments make the conventional paper feeders or sheet separators expensive and subject to trouble which may occur, because the adjustment has changed during the operation. Further, the adjustments are time consuming.

In many office machines it is customary to use interfolded, continuous sheets of paper or sets of office form. This is, for example, the case in automatic typewriters, accounting machines, and data processing machines. Such continuous, interfolded forms are provided with a row of apertures running along one edge or margin of the sheet for assuring a line true feed advance of the sheet in the machine. After the continuous sheets have passed through the office machine, they are separated from each other, and it is necessary to remove the margin of apertured strip. This involves additional labor and may even require additional machines which can remove the margin. Thus, these machines have the common disadvantage that pre-printed letterheads, invoice forms, and the like, which are available as individual sheets only, cannot be used in this type of machine which makes it necessary to have these forms and letterheads prepared especially for use in the just described type of machine. U.S. Pat. No. 3,963,110 describes a storage magazine and sheet feeder for a typing apparatus such as a tape driven typewriter, wherein the tray for supplying new sheets and the tray for receiving the typed up sheet extends at a steep angle above the typewriter platen, presumably, to take advantage of gravity for feeding the sheets to the typewriter platen. However, while this may be advantageous as far as the sheet supply is concerned, it is not desirable as far as the sheet removal is concerned because the sheets have to be driven against gravity up again. Moreover, there is no assurance in this type of feeder that only one sheet at a time or one set of sheets at a time will be supplied to the platen regardless of the thickness of the sheet or set of sheets.

Similar considerations apply to the paper feeder according to U.S. Pat. No. 3,430,748 which is coordinated with the platen in a typewriter which also does not assure that one and only one sheet or one set of sheets will be supplied to the platen.

OBJECTS OF THE INVENTION

In view of the above, it is the aim of the invention to achieve the following objects, singly or in combination:

- to separate sheets of paper from a stack individually and independently of the thickness of the paper sheets;
- to provide an apparatus capable of separating paper sheets from a stack, whereby the individual sheets of paper may have different thicknesses even in the same stack;
- to construct the sheet separating apparatus in such a manner that transporting more than one sheet or one set of sheets at a time regardless of the thickness of the sheets or sets of sheets will be avoided;
- to provide a sheet feeder which will supply individual sheets without a perforated margin into office machines, such as automatic typewriters, accounting machines, data processing machines, copiers, and teletypewriters, whereby said feeding must be automatic and precise; and
- to feed sheets into machines of the type just mentioned while maintaining the supply magazine as well as the receiving magazine in a substantially horizontal position or in a position which is only slightly slanted relative to the horizontal.

SUMMARY OF THE INVENTION

According to the invention there is provided an apparatus for individually removing or separating sheets from a stack, wherein the sheet stack support is constructed as a see-saw and wherein a plurality of rollers cooperate with the see-saw and with further elements for the sheet removal and advance from the stack. One sheet at a time will pass through the apparatus to avoid clogging. A spring urges the see-saw type of support and thus the sheets of paper on the support against a first set of rollers rotatably supported in the housing of the apparatus. These rollers are motor driven. A table or surface is arranged substantially adjacent to the downstream end of the support and a further set of motor driven rollers is arranged above the table. A stop surface or member is arranged downstreamm and adjacent to the sheet stack support. The table and the first set of rollers are arranged in such a manner relative to each other that the line of contact between the first set of rollers and the top sheet of the stack is located substantially in the same plane as that defined by the table. A separating gate is arranged below the table but reaches through a cut-out in the table at an angle relative to the table. The separating gate is located below the second set of separating rollers. The top surface of the separating gate is provided with friction increasing cover means to retard a second sheet that might have been advanced below and along with the top sheet from a stack.

According to the invention, there is further provided a first set of sheet guide means which supply the sheets or sets of sheets individually from a sheet separating device as described above, toward a roller such as the platen in a typewriter on the back side or upstream side thereof and that a second set of guide means is arranged to guide the sheets backwardly into a tray arranged above the supply tray. This combination of elements makes it possible to use standard letterheads, preprinted forms, invoice forms and the like, without any continuous folding and also without any marginal perforation. The invention has the further advantage that the subsequent separation of sheets from an endless interfolded sheet supply becomes unnecessary. Similarly, the removal of the perforated margin has been avoided, according to the invention. A still further advantage of the invention is seen in that it may be combined with any conventional office machine and may also be removed as an integral structural unit.

The above combination of features according to the invention has the further advantage that no adjustment of the various elements relative to each other is necessary while simultaneously sheets of paper having different thicknesses may be processed. Even in one and the same stack the sheets may have individually differing thicknesses.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS

Figure 1:
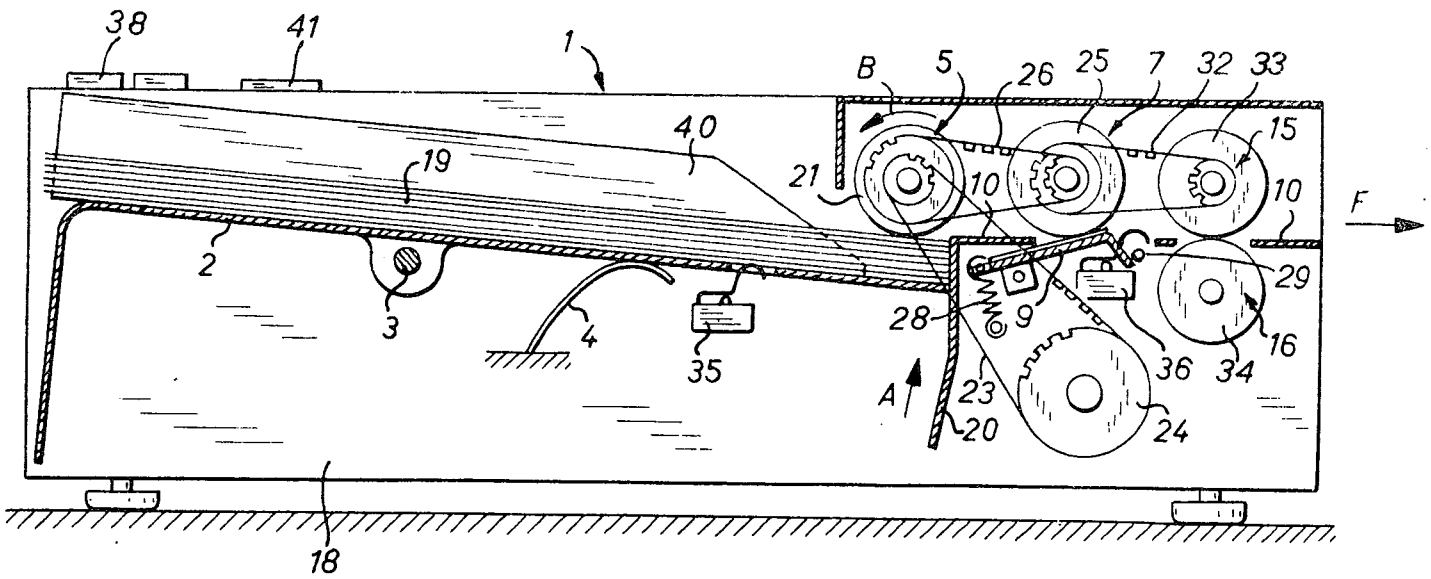
FIG. 1 is a vertical section through the sheet separator of my above mentioned patent application.

Referring to FIG. 1 the sheet separating apparatus of the present invention includes a housing 1 made of sheet metal or plastics material. A sheet supply stack support 2 is journaled in the housing in the manner of a see-saw. The support carries a stack 19 of paper sheets to be individually removed from the stack 19 for further processing to and around the platen 361. The journal axis 3 of the see-saw type of support 2 is secured to the side walls 18 of the housing 1 for a tilting movement. The journal axis 3 extends horizontally through the housing. The support 2 is urged in the direction of the arrow A upwardly by means of a relatively weak spring 4. The stack 19 of sheets of paper or sets of sheets with carbon paper therebetween is manually placed on top of the support 2 in such a manner that the forward edge of the stack rests snuggly against a substantially vertically extending stop member 20. An upwardly extending wall member 40 is laterally adjustable back and forth to fix the position of the in the lateral direction. Referring further to FIG. 1, a first sheet separating set of rollers 5 is supported for rotation in the housing 1 above the downstream end of the stack 19 and close to the stop member 20. The set 5 of sheet separating rollers comprises a plurality of rollers 21 axially spaced along and rigidly secured to a horizontal shaft 6, which in turn is rotatably supported in the side walls of the housing 1. A drive motor 24 drives the shaft 6 in the direction of the arrow B by means of a power transmission element such as a gear belt 23. The top sheet on the stack comes into contact with the lower surface of the rollers 21 because the spring 4 urges the support 2 and thus the stack 19 lightly in the upward direction and hence against the rollers 21. The line of contact between the top sheet and the rollers 21 is located practically at the same level as a substantially horizontally extending table surface 10 of metal, plastics, or the like. The sheets travel individually over the table surface 10 in the direction of the arrow F after removal of a sheet from the stack 19.

Figure 3:
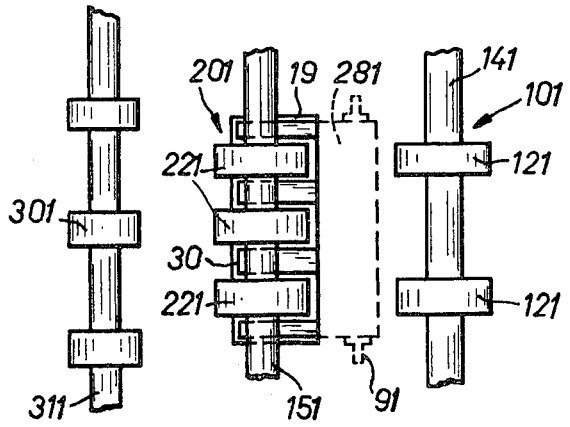
FIG. 3 illustrates a top view onto the sheet separating sets of rollers also showing the sheet separating gate in dashed lines below the table over which the sheets advance.

Above the table surface 10 and substantially at the same level as the first sheet separating roller set 5, there is arranged a second sheet separating roller set 7, which comprises several rollers 25 rigidly secured to a shaft 8 driven by a transmission member, such as a gear belt 26. The rollers 25 have the same diameter as the rollers 21. The diameter of the drive gears for the roller sets 5 and 7 are selected in such a manner that an upward translation is accomplished. In other words, the rollers 25 rotate faster than the rollers 21, or rather the circumferential speed of the rollers 25 is larger than that of the rollers 21. The rollers 25 of the second set 7 are located above a cut-out 27 in the table surface 10 as best seen in FIGS. 1 and 3. A separating gate 9 extends through the cut-out 27 at an angle relative to the table surface 10. Preferably, the angle is within the range of 8° to 15°.

Figure 5:
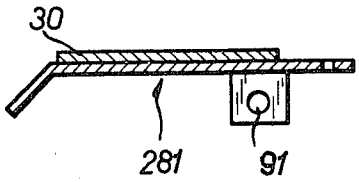
FIG. 5 is a sectional view through the sheet separating gate according to FIG. 4.

The separating gate 9 is supported in the housing also in see-saw fashion by a journal axis 91 (FIG. 5). A spring 28 urges the separating gate 9 in a counter-clockwise direction and thus with a slight pressure toward the rollers 25, however, without contacting these rollers directly. A bent over portion of the separating gate 9 extends substantially downwardly and rests against an adjustable stop member 29, whereby the spacing between the separating gate 9 and the rollers 25 may be varied within a limited range. The stop member 29 is adjustable from outside the housing of the apparatus and may comprise a cam member extending more or less toward the bent down portion of the separating gate 9 depending on the position of the stop member 29.

Figure 4:
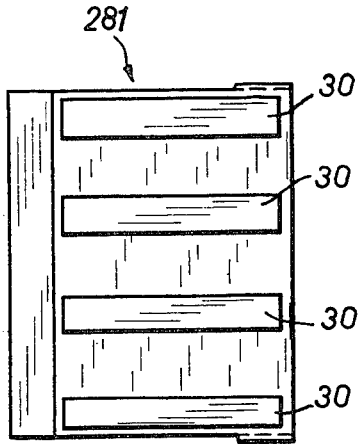
FIG. 4 is a top view onto the sheet separating gate.

As shown in FIGS. 4 and 5, the separating gate 9 is provided at its top surface with friction increasing means. Preferably, these friction increasing means are rubber strips 30 extending in the transport direction F. These rubber strips 30 increase the friction relative to a sheet of paper moving over the separating gate 9. The strips 30 are preferably made of soft rubber having a higher coefficient of friction relative to paper than steel. Thus, the individual sheets encounter a larger frictional resistance relative to the rubber strips 30 and thus against a movement in the transport direction F than on the table 10, whereby only the upper sheet will be transported and any sheet that might have left the stack below the top sheet will be retarded, so that only the top sheet will be transported in the direction of the arrow F. The rubber strips 30 extend upwardly somewhat above the level defined by the lower side of the rollers 25, whereby each individual sheet takes on a somewhat corrugated shape as it passes below the rollers 25 since the strips 30 are also spaced in such a manner that the rollers 25 are located above these spaces between the strips 30.

Figure 2:
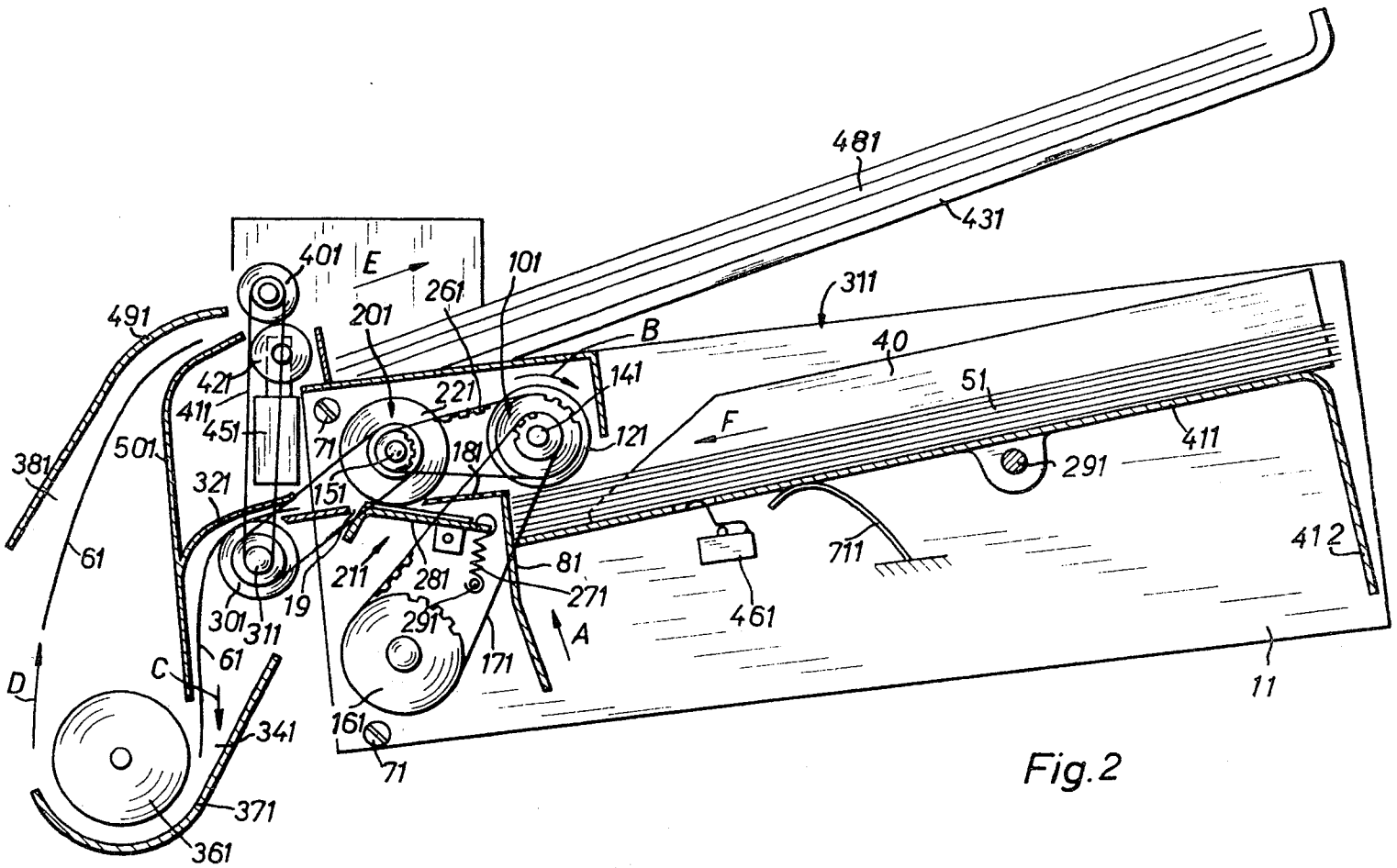
FIG. 2 is a sectional view similar to that of FIG. 1, however, showing the improvement according to the present invention, specifically illustrating the sheet guide means and the location of the sheet receiving tray substantially above the sheet supply tray.

Downstream of the second separating roller set 7 and horizontally spaced therefrom there are arranged two more roller sets 15 and 16 located vertically one above the other, or somewhat displaced relative to each other in the feed advance direction. The further roller sets 15 and 16 form a contact plane with the sheet to be transported or they form a narrow gap therebetween substantially in the plane of the top surface of the table 10. For this purpose a further cut-out is provided in the table 10 as seen in FIG. 2, and the lower set of rollers 16 reaches through said further cut-out in the table 10. The drive for the roller set 15 is derived from the drive of the roller set 7 by means of a transmission member, such as a gear belt 32. An upward transmission or translation is provided between these two rollers so that the roller set 15 is driven faster than the roller set 7. Preferably, one of the two roller sets 15 or 16 is vertically adjustable or spring supported. In those instances, where the individual sheets are immediately taken up as they emerge from the gap between the gate 9 and the rollers 25, for example by a further processing apparatus as shown in FIG. 2, it may not be necessary to employ the roller sets 15 and 16 at all. The rollers 21, 25 and 33 are provided around their circumference with a soft rubber or a soft synthetic material layer having a relatively high friction coefficient relative to paper. Each of the rollers 21 and 25 and preferably also the rollers 33 and 34 are provided with a free wheeling take over mechanism. Such mechanisms are well known in the art, for example, in connection with free wheeling bicycle drives. These free wheeling rollers are capable of rotating faster than the speed determined by the drives through the gear belts 23, 26 and 32. This situation may occur when an individual sheet is taken up by the rollers 25 which have a larger circumferential speed than the rollers 21. The same situation would occur when the sheet is taken up between the rollers 33 and 34, since the set of rollers 15 is driven faster than the set of rollers 7. The increasing of the rotational speeds in the transport direction has the advantage that individual sheets are prevented from getting stuck.

The apparatus according to my above mentioned previous invention operates as follows. A stack 19 of paper sheets, which may have varying thicknesses up to the thickness of semi-cardboard, is manually placed on the support 2 so that the topmost sheet rests against the rollers 21 of the first set 5 of sheet separating rollers. The spring 4 presses the support 2 with a small force against these rollers 21 of the first set 5. The motor 24 is now started by pressing a button, not shown, whereby the first topmost sheet is transported in the direction F. Normally only the topmost sheet will be transported. However, if one or more additional sheets should be taken along, for example, when these sheets stick to each other, no problem will result, because of the arrangement of the cooperating parts relative to each other, whereby it is prevented that more than one sheet is supplied, for example, to a copier or to a typewriter platen 361 as shown in FIG. 2. The cooperation between the separating gate 9 and the second set of separating rollers 25 prevents a second sheet from travelling along with the top sheet in the direction of the arrow F. This is accomplished because only the top sheet is held against the rollers 25, whereas any sheet below the top sheet is retarded by the rubber strips 30 on the surface of the separating gate 9, because these rubber strips 30 have a relatively large friction coefficient relative to paper.

Due to the somewhat slanted position of the separating gate 9 relative to the table surface 10, a sheet advancing on the table is forced into a narrowing gap, whereby only the top sheet will be further transported. As soon as the top sheet is contacted by the second separating roller set 7, the speed of the sheet is increased in the direction of the arrow F, whereby the rollers 21 reach the same speed as the rollers 25 of the second set, because both rollers 21 and 25 roll along the same sheet. This is possible due to the free wheeling of these rollers similarly to the free wheeling or coasting of a bicycle. Thus, the rollers 21 may run faster than they are driven by the motor 24. As soon as a sheet has passed the rollers 21 of the set 5, the latter takes up the speed by which it is driven through the motor 24. This has the advantage that a spacing is established between successive sheets, which is important if, for example, the further handling of the sheets is controlled through photocells, which respond to such spacings between successive sheets.

As soon as a sheet, which is driven by the rollers 25 of the second set, comes into the gap between the rollers 33 and 34, these rollers further transport the sheet. The rollers 33 and 34 are driven faster than the rollers 25 of the second set 7. This further increases the spacing between two successive sheets. However, as mentioned, it might not be necessary to arrange the roller sets 15 and 16 as part of the present apparatus. Such rollers may form the input gap of a next successive machine or of an intermediate conveyor device.

The electrical control may be such that merely individual sheets are separated from the stack one at a time as needed, or the arrangement may be such that the sheet separation takes place in a continuous repeatedly successive operation. If the separation takes place only once in a while, the motor 24 may be started by pressing a respective button or the motor may receive a starting impulse from an apparatus arranged downstream of the present sheet separating device such as a typewriter or accounting machine. The motor is stopped by interrupting the energizing circuit for the motor 24 through a micro-switch 36, which responds to the trailing edge of a sheet passing over a sensing member 37 of a micro-switch 36, whereby the sensing member 37 reaches through the cut-out 27 in the table 10. Thus, the micro-switch 36 is actuated substantially as soon as the sheet leaves the gap between the rollers 25 and the gate 9. On the other hand, where a continuous operation is desired, it is the purpose of the micro-switch 36 to actuate a counter 41 which will switch off the motor 24 upon reaching a preadjusted number of sheets. These arrangements are as such well known in the art. Furthermore a micro-switch 35 having a sensing lever 38 reaching through an aperture in the support 2, whereby the switch 35 will stop the motor 24 when the last sheet of a stack 19 has been taken off the support 2. Incidentally, the entire apparatus may be constructed as a portable unit and provided with feet 39 to place it on a table or the like.

FIG. 2 illustrates the improvement according to the present invention. The individual sheets 61 are removed from the stack 51 and supplied to the platen 361, for example, of a typewriter or an accounting machine. From the platen the sheets 61 with the typing thereon are moved in the direction of the arrow D and further in the direction of the arrow E onto a receiving stack 481 held on a receiving tray 431.

The sheet separating device 211 is substantially of the same structure as described above, with reference to FIG. 1, thus, the sheet separator proper 211 is arranged in a housing 311, the side walls 40 of which support a sheet supply tray 411 in see-saw fashion, the supply tray 411 is again lurched in the direction of the arrow A by a spring 711. The downwardly bent end 412 of the tray 411 provides a limit stop for the clockwise movement of the tray 411. The sheets 61 are placed manually onto the tray 411 so that the leading edge of the sheets contact the stop 81 extending substantially at right angles to the feed advance direction F. The sheet separator 281 is also supported in see-saw fashion on an axle 291 in the side walls 11 of the housing 311. A first sheet separating set of rollers 101 is arranged above the stop 81 and above the supply stack 51. The first sheet separator set comprises a plurality of rollers 121 arranged in a row and supported on a horizontal shaft 141 to which the rollers 121 are rigidly secured against rotation. The shaft 141 is driven by a motor 161 through a gear belt 171, as indicated by the arrow B. Since the spring 711 of the sheet supply tray 411 with the stack 51 thereon presses the whole tray upwardly against the rollers 121, the leading end of the top sheet of the stack 51 contacts the rollers 121. The lowest generatrix of the rollers 121 is substantially at a level of a table 181 over which the sheets are individually transported. Preferably, the table 181 is an integral unit with the stop 81 and bent substantially at right angles, as shown in FIG. 2.

Above the table 181 as viewed in the transport direction F, there are arranged downstream of the first set 101, a further set of sheet separating rollers 201 comprising a plurality of rollers 221 secured to a common shaft 151 driven by a gear belt 261 which derives its driving force from the motor 161 through the gear belt 171. The rollers 121 and the rollers 221 have the same diameter. Preferably, the gear belt 261 provides for an upward speed translation so that the rollers 201 run faster than the rollers 121. Thus, the circumferential speed of the rollers 221 is larger than that of the rollers 121.

The second set of rollers 201 is arranged above the cut-out 27, shown in FIG. 1, provided in the table 10 and also in the table 181 of FIG. 2. The separator gate 281 is arranged to reach through this cut-out and tiltable about its tilt axis 291. The tilting axis 291 is arranged below the table 181 and the spring 271 urges the sheet separator gate 281 against the rollers 221. As described, the gate 281 is also provided with a friction increasing means 30 as shown in FIG. 5. The friction increasing means 30 are preferably provided in strips as best seen in FIG. 4. The strips or a continuous coating may, for example, be made of soft rubber having a relatively high friction coefficient relative to paper so that the separated paper sheets encounter a higher friction relative to the separating gate 281 in the transport direction than on the table 181. The rubber strips extend above the level defined by the lowest generatrix of the rollers 221 so that a transported sheet will take on a slightly wavy, corrugated shape.

Further, as described, the rollers 121 and 221 are provided with a free wheeling over drive or idle running device so that they may run faster than the speed determined by the drive of the motor 161. This is the case, where the sheet is transported faster by the downstream sheet handling elements than by the speed determined by the motor 161. The just described sets of rollers 101 and 201 make sure that only one sheet at a time is supplied to the platen 361 over a guide roller 301 secured to a shaft 311 also driven by a gear belt through the previously mentioned gear belt 171 and 261. A guide member 321 is arranged to cooperate with the guide roller 301 for moving a sheet 61 into the entrance gap 341 defined between a further guide member 371 and the platen 361. This feed-in gap 341 may comprise conventional pressing rollers for the sheet 61 which rollers are not shown for simplicity's sake. The sheet 61 is now located behind the platen 361 in the feed-in gap 341 and as the platen 361 rotates, typing may begin by, for example, a type head not shown. The platen is advanced line by line to move the sheet towards the front side of the platen 361 in the direction of the arrow D and thus into a funnel 381 which guides the sheets 61 between two guide members 491 and 501. The funnel 381 has such a shape that it diverts the sheet 61 into the direction E which is substantially opposite to the feed advance direction F.

At the output end of the funnels 381 there is arranged a pair of rollers 401 and 421 normally so spaced that the sheet emerging from the funnel may easily pass between these rollers 401 and 421 without any pull being applied to the sheet by the rollers. One of these rollers is supported on its axle in a manner permitting a shifting of the axle substantially up and down by means of electromagnets 451. If these electromagnets are energized, the respective roller is pressed against the other roller of the pair, whereby the sheet is firmly held between these rollers. One of the rollers is positively driven, for example, also through the motor 161 through gear belts 411, whereby the sheet is positively transported in the discharge direction E and onto the stack 481 held on a tray 431 in the form of rods or the like. Thus, it is possible, according to the invention, to arrange the two trays 411 and 431 substantially one above the other, as illustrated, which has the advantage that the space above the typewriter is not cluttered by the trays as in the prior art. The total angle between the two trays is within the range of 340° to 360°. The tilt of the supply tray 411 and also of the receiving tray 431 relative to the horizontal should not exceed 30°, preferably it should be within the range of 10° to 20°.

The control of the sheet supply may be arranged in response to the operation of the typewriter as is conventional. When all the sheets 51 are removed from the stack, the whole system, including the typewriter, may be stopped, for example, through a micro switch 461. Moreover, as mentioned above, the entire apparatus may be constructed as an attachment unit. The connection may either be of the slip-on or clip-on type or screws 71 may be used for the purpose.

Although the invention has been described with reference to specific example embodiments, it is to be understood, that it is intended to cover all modifications and equivalents within the scope of the appended claims.

What is claimed is:

1. An apparatus for the automatic supply of individual sheets from a sheet supply stack to a roller in an office machine and back onto a sheet receiving stack, comprising sheet separating means, first sheet guide means which guide the sheets delivered by said sheet separating means from said sheet supply stack and feed these sheets to the back side of said roller, and second sheet guide means arranged in front of said roller, said second sheet guide means moving a sheet upwardly onto said sheet receiving stack located substantially above said supply stack, wherein said first sheet guide means deflects the sheets supplied by the sheet separating means by an angle of at least 45°, preferably by an angle of 90° toward said roller in the office machine, and wherein said second guide means comprise funnel means for the sheets for deflecting the sheets delivered by said roller into a direction which is extending substantially oppositely to the supply direction of said sheets of paper, wherein said second guide means further comprise two sheet withdrawing rollers arranged downstream of said funnel means, electromagnet means operatively connected to selectively separate said two withdrawing rollers from each other, and motor means operatively connected for positively driving at least one of said two withdrawing rollers, and wherein said sheet separating means comprises tiltable rocker means to hold the sheet supply stack, said sheet separating means further comprising a stop member against which the leading edges of the sheets in the sheet supply stack rest.

2. The apparatus of claim 1, wherein said sheet separating means comprises several motor driven sheet separating roller sets, one of which bears against said sheet supply stack, and wherein said sheet supply stack as well as the sheet receiving stack are tilted relative to the horizontal by an angle up to 30°.

3. The apparatus of claim 1, wherein said sheet separating means comprise table means and roller means arranged above said table means, separating blade means extending through the table means for cooperation with said sheet separating roller means, and friction means arranged on said sheet separating roller means.

4. The apparatus of claim 1, wherein said sheet separating roller means comprise a first set of separating rollers and a second set of separating rollers, said second set of separating rollers being driven faster than the first set of separating rollers, and wherein both sets of separating rollers comprise free wheeling, idle running means.

5. A sheet feeding and receiving apparatus for directing sheets of paper to and receiving said sheets from platen means in an office machine, comprising a first set of axially aligned and spaced apart driven rollers, a pivotally mounted stack support, means resiliently urging the leading edge of an upper sheet on said stack support against said first set of rollers, a stop engaging the lower sheets on said stack support, a second set of axially aligned and spaced apart positively driven rollers positioned downstream of said first set in the transport direction of sheets on said stack, a table surface positioned between said first and second sets of rollers at substantially the same level as the bottoms of the rollers of said first and second sets, whereby said rollers of said first two sets separate a sheet from said stack and feed the separated sheet along said table surface toward said second set of rollers, a cut-out in said table surface below said second set of rollers, a gate pivotally mounted at said cut-out, means resiliently urging said gate upwardly through said cut-out toward said second set of rollers, friction increasing means on top of said gate and axially separated from said rollers of said second set, stop means inhibiting contact between rollers of said second set and said gate, whereby said second set of rollers and said friction increasing means inhibit the passage of more than one sheet through said apparatus independently of the thickness of said sheets, said apparatus further comprising first sheet guide means which guide a sheet delivered by said second set of rollers to said platen, a receiving stack support arranged substantially above said pivotally mounted stack support, second guide means arranged above and downstream of said platen means for directing sheets upwardly from below said platen means to said receiving stack support for storing sheets received from said platen.

6. The apparatus of claim 5, wherein said second guide means comprise a pair of rollers positioned above said platen means to feed sheets from said platen means to said receiving stack.

7. The apparatus of claim 5, further comprising electromagnet means for selectively separating said pair of rollers.

* * * * *